United States Patent [19]

Parks et al.

[11] 4,324,272

[45] Apr. 13, 1982

[54] ANTI-SLOSH BAFFLE COMPARTMENT ASSEMBLY

[75] Inventors: Edward G. Parks, Encinitas; August J. Troncale, Jr., San Diego, both of Calif.

[73] Assignee: The United States of America as represented by the Secretary of the Navy, Washington, D.C.

[21] Appl. No.: 197,736

[22] Filed: Oct. 17, 1980

[51] Int. Cl.[3] ..... F42B 19/00

[52] U.S. Cl. ..... 137/574; 137/575; 114/20 R

[58] Field of Search ..... 137/571, 573, 574, 575, 137/576; 114/20 R, 20 A; 220/20.5, 22

[56] References Cited

U.S. PATENT DOCUMENTS

| | | | |
|---|---|---|---|
| 1,077,311 | 11/1913 | Shonrard | 114/20 R |
| 1,207,333 | 12/1916 | Shonrard | 114/20R |
| 1,445,936 | 2/1923 | Dieter | 114/20 R |
| 1,460,370 | 7/1923 | Dieter | 114/20 R |
| 2,651,951 | 9/1953 | Du Rant | 137/575 X |
| 3,903,924 | 9/1975 | Readman | 137/574 |
| 4,210,176 | 7/1980 | Emming | 137/573 X |

*Primary Examiner*—A. Michael Chambers

*Attorney, Agent, or Firm*—Robert F. Beers; Ervin F. Johnston

[57] ABSTRACT

An anti-slosh fuel compartment assembly is provided for a vehicle wherein the vehicle has a forward gas pressurized fuel compartment and an aft fuel feeding compartment. The anti-slosh fuel compartment assembly includes an intermediate compartment which is mounted between the forward and aft fuel compartments. A device is provided for sealing the intermediate compartment to the vehicle so that the forward and aft fuel compartments are sealably separated from one another. An upwardly extending tube is mounted in a fore-part of the intermediate compartment with a bottom end of the tube opening into a bottom portion of the forward compartment and a top end opening into a top portion of the intermediate compartment. Another upwardly extending tube is mounted in an after part of the intermediate compartment with a bottom end spaced from the bottom of the intermediate compartment and a top end in communication with the aft compartment so that fuel is communicable from the forward compartment to the aft compartment through the intermediate compartment. With this arrangement gas will be trapped in the intermediate compartment to prevent its travel to the aft compartment even though the vehicle undergoes severe down movements.

5 Claims, 3 Drawing Figures

ANTI-SLOSH BAFFLE COMPARTMENT ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention pertains to an apparatus for preventing the communication of gas from one compartment to another compartment in a system which utilizes gas pressurized fuel.

The U.S. Navy literally utilizes thousands of torpedoes for exercise purposes. Once these torpedoes are fired they undergo radical movements according to their programmed search mode. After utilizing a quantity of fuel, the torpedo passes from a negative buoyant condition to a positive buoyant condition so that it will float to the surface for recovery purposes. The Navy has had a problem with these torpedoes since, prior to the torpedo becoming positively buoyant, gas used for pressurizing the fuel has found its way to the torpedo engine when the torpedo undergoes severe down movements. This causes the engine to stop and the torpedo sinks to the bottom of the ocean. During a severe down movement, in which a negative g situation occurs, the pressurization gas in a forward fuel compartment is forced thru a bottom mounted feed tube into an aft fuel compartment. Any subsequent negative g situation will allow pressurization gas to be delivered to the engine, causing the torpedo to stop and sink to the bottom. Many attempts have been made to solve this particular problem with no avail.

SUMMARY OF THE INVENTION

The present invention provides an anti-slosh fuel compartment assembly for a vehicle, such as a torpedo, wherein the vehicle has a forward gas pressurized fuel compartment and an aft fuel feeding compartment. The anti-slosh fuel compartment assembly includes an intermediate compartment mounted between the forward pressurized fuel compartment and the aft fuel feeding compartment. A device is provided for sealing the intermediate compartment to the vehicle so that the forward and aft compartments are sealably separated from one another. An upwardly extending tube is mounted in a fore part of the intermediate compartment with a bottom end of the tube opening into a bottom portion of the forward compartment and a top end opening into a top portion of the intermediate compartment. Another upwardly extending tube is mounted in an after part of the intermediate compartment with a bottom end spaced from the bottom of the intermediate compartment and a top end in communication with the aft compartment so that fuel is communicable from the forward compartment to the aft compartment through the intermediate compartment. With this arrangement gas will be trapped in the intermediate compartment to prevent its travel to the aft compartment even though the vehicle undergoes radical down movements.

OBJECTS OF THE INVENTION

An object of the present invention is to provide an anti-slosh fuel compartment assembly which will effectively diminish fuel entrained gas from passing from a forward fuel compartment to an aft fuel compartment.

Another object is to provide a pressure compensated anti-slosh fuel compartment assembly which can be mounted between forward and after fuel compartments in a vehicle for preventing fuel entrained gas in the forward compartment from entering the after fuel compartment.

A further object is to provide an anti-slosh fuel compartment assembly for a torpedo wherein the fuel compartment assembly is light in weight, of minimum construction, and is effective for preventing fuel entrained gas from transitioning from a forward fuel compartment in the torpedo to an after fuel compartment therein.

These and other objects of the invention will become more readily apparent from the ensuing specification when taken together with the drawings.

DESCRIPTION OF THE PREFERRED EMBODIMENT

Figure 1:
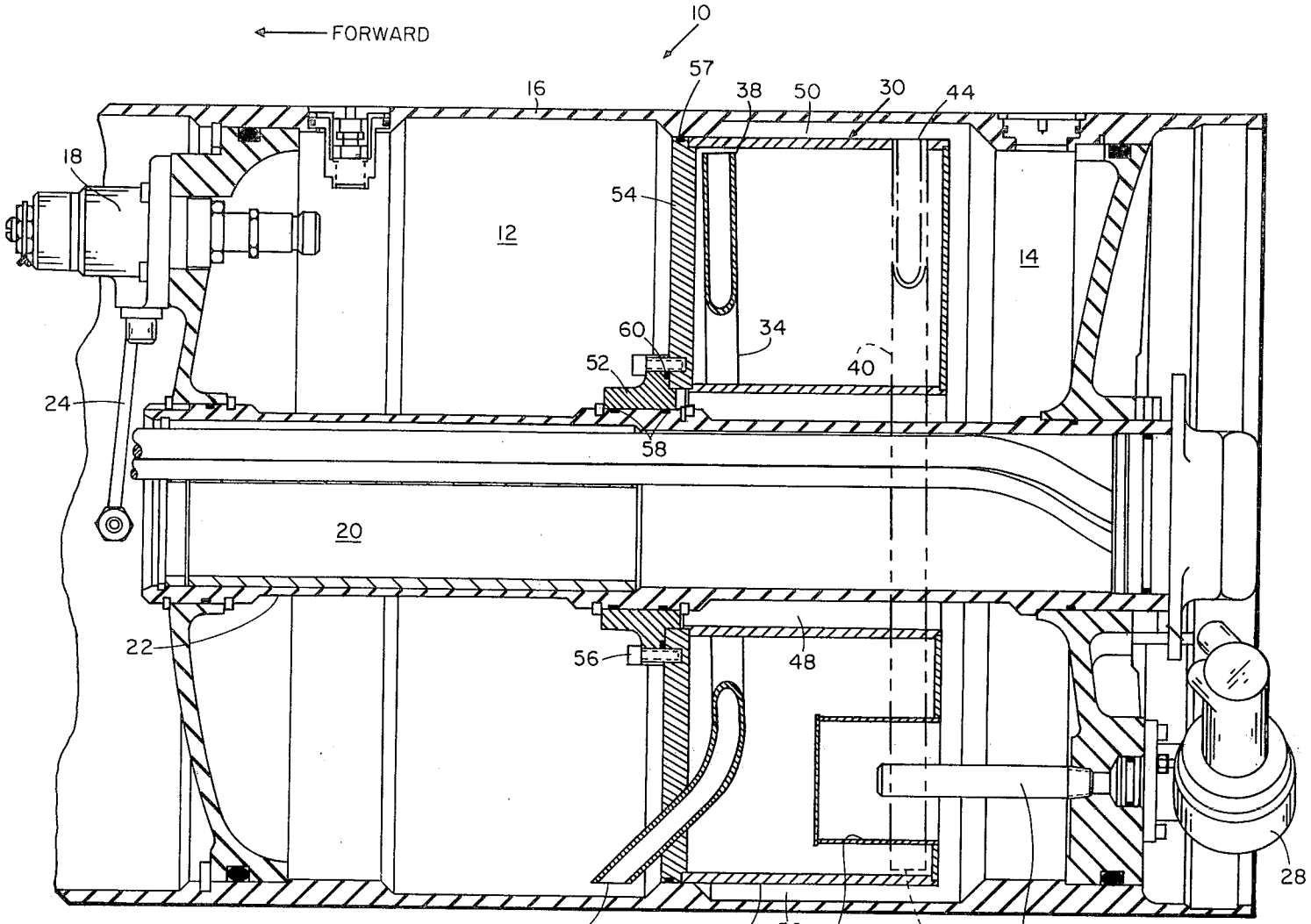
FIG. 1 is a longitudinal cross sectional view of a portion of a torpedo with portions shown in full therein and with the anti-slosh fuel compartment shown mounted therein between forward and aft fuel compartments.
Figure 2:
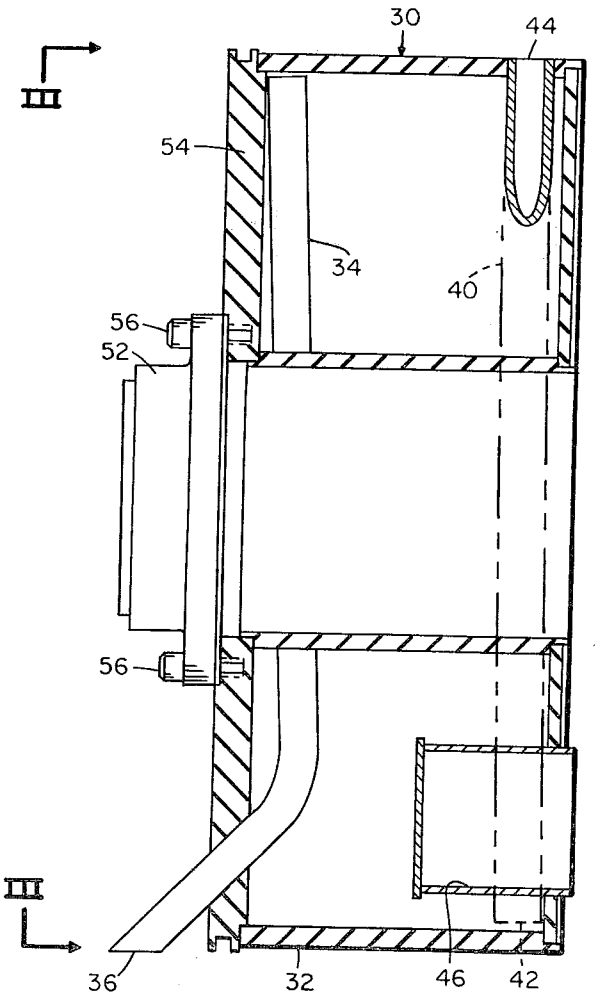
FIG. 2 is a longitudinal cross sectional view of the anti-slosh fuel compartment assembly.
Figure 3:
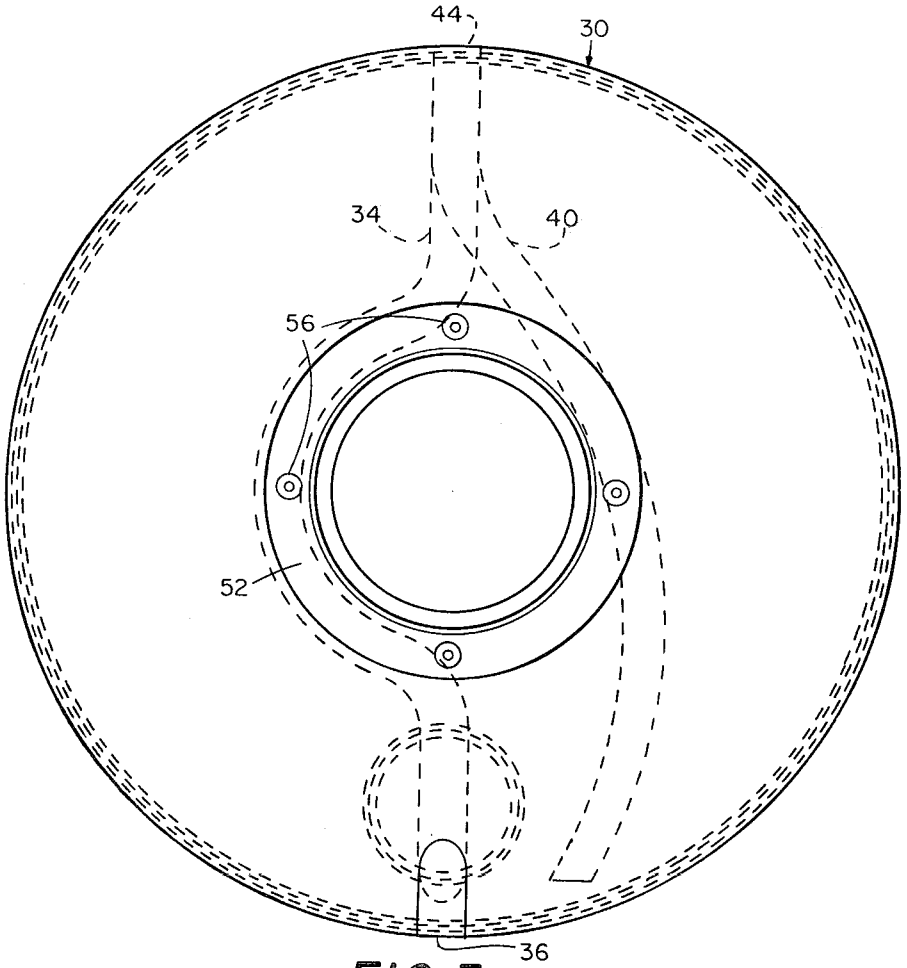
FIG. 3 is a view taken along plane III—III of FIG. 2.

Referring now to the drawings wherein like reference numerals designate like or similar parts throughout the several views there is illustrated in FIG. 1 a portion of a torpedo 10 which includes a forward gas pressurized fuel compartment 12 and an after fuel feeding compartment 14. These compartments are formed by an outer shell 16. Fuel in the forward compartment 12 is gas pressurized by a pressure regulator 18, the gas preferably being $CO_2$. The $CO_2$ is provided by a $CO_2$ bottle (not shown) which is mounted in a space 20 within a central tube 22 which passes axially through the torpedo. The pressure regulator 18 receives the pressurized $CO_2$ via a pressure line 24. These elements are not part of the invention, but are identified to establish the fact that fuel within the forward compartment 12 is pressurized by a gas, such as $CO_2$.

In the after compartment 14 the pressurized fuel is picked up by a feed tube 26 which in turn feeds the tube to an interlock valve 28. The interlock valve 28 subsequently feeds the fuel to a torpedo engine (not shown). It is important that fuel entrained gas within the forward compartment 12 be prevented from entering the aft compartment 14 where fuel is ultimately fed to the torpedo engine. Fuel entrained gas in the after compartment 14 can easily find its way to the engine to shut it down and terminate operation of the torpedo. If sufficient fuel has not been utilized to make the torpedo positively buoyant, the torpedo will sink to the bottom of the ocean.

The present invention is an anti-slosh fuel compartment assembly 30 which can be mounted in a vehicle, such as a torpedo, for preventing gas from traveling from the forward fuel compartment 12 to the after fuel compartment 14. The anti-slosh fuel compartment assembly 30 includes an intermediate compartment 32 which is mounted between the forward compartment 12 and the aft compartment 14. Means, which will be described in detail hereinbelow, are provided for sealing the intermediate compartment to the torpedo so that the forward pressurized fuel compartment 12 and the aft fuel feeding compartment 14 are sealably separated from one another.

The anti-slosh fuel compartment assembly 30 includes an upwardly extending tube 34 which is mounted in a fore part of the intermediate compartment 32 with a bottom end 36 of the tube opening into a bottom portion of the forward compartment 12 and a top end 38 of the tube opening into a top portion of the intermediate compartment. The anti-slosh fuel compartment assembly 30 further includes another upwardly extending tube 40 which is mounted in an after part of the intermediate compartment 32 with a bottom end 42 of the tube spaced from the bottom of the intermediate compartment and a top end 44 which is in communication with the aft compartment 14. With the arrangements of the tubes 34 and 40 fuel is communicable from the forward compartment 12 to the aft compartment 14 through the intermediate compartment 32. Further, it can be visualized that when the torpedo undergoes a severe down movement that fuel entrained gas within the forward compartment 12 will have much difficulty in transitioning passed the intermediate compartment 32. When the torpedo does undergo a negative gravity condition, gas entrained bubbles within the forward compartment 12 will rapidly migrate downward towards the bottom of the forward compartment. Any gas bubbles which are picked up by the bottom end of the tube 36 are communicated to the top portion of the intermediate compartment 32 where they will reside since the torpedo has normally terminated its negative gravity condition.

When the fuel level within the compartments 12, 32 and 14 lowers, it can be visualized that more gas is in the upper portions of the compartments and the danger of gas entering the forward end of the fuel tube 26 increases. To minimize this condition the intermediate compartment 32 has been provided with a recess 46 which is located in a bottom portion thereof and which faces aft to receive the feed tube 26. With this arrangement fuel entrained gas has an additional difficulty in entering the feed tube 26 since it is protected from the sloshing condition within the recess 46.

A feature of the invention is that the anti-slosh fuel compartment assembly 30 is pressure compensated so that it can be light in weight and constructed with minimum thicknesses of materials. This has been accomplished by making the intermediate compartment 32 annular about the central tube 22 and spaced therefrom to form an inner annular space 48 therebetween. Further, the intermediate compartment 32 is spaced from the outer cylindrical shell 16 to form an outer annular space 50 therebetween. As can be seen from FIG. 1, the inner and outer annular spaces 48 and 50 respectfully are open to and are in communication with the aft fuel compartment 14. Accordingly, the pressure within the intermediate compartment 32 and outside the intermediate compartment within the aft compartment 14 are the same so as to pressure balance the intermediate compartment.

In order to mount the anti-slosh fuel compartment assembly within the torpedo 10 an annular hub 52 may be provided. The annular hub 52 is mounted about the central tube 22 and may be affixed to a forward plate 54 of the intermediate compartment 32 by bolts 56. As can be seen from FIG. 1, the hub 52 literally cantilevers the intermediate compartment 32 within the aft fuel compartment 14. Of considerable significance is the fact that the intermediate compartment is sealed to the torpedo so that the forward and aft compartments 12 and 14 are sealably separated from one another. This important sealing function may be accomplished by an O-ring 57 which seals the intermediate compartment 32 to the outer shell 16, a pair of O-rings 58 which seal the hub 52 to the central tube 22, and an O-ring 60 which seals the intermediate compartment 32 to the hub 52.

It is now readily apparent that the present invention provides a simple and efficient assembly for preventing fuel entrained gas from transitioning from a forward fuel compartment to an aft fuel compartment. The invention is a significant improvement over the simple baffle arrangement used in the prior art. The structure of the present invention enables the present invention to simply be substituted for the ordinary baffle without modifications of existing vehicle construction.

Obviously, many modifications and variations of the present invention are possible in the light of the above teachings, and, it is therefore understood that within the scope of the disclosed inventive concept, the invention may be practiced otherwise than as specifically described.

What is claimed is:

1. An anti-slosh fuel compartment assembly for a vehicle wherein the vehicle has an outer cylindrical shell which forms a forward gas pressurized fuel compartment and an aft fuel feeding compartment comprising:

an intermediate compartment mounted between the forward pressurized fuel compartment and the aft fuel feeding compartment within said outer cylindrical shell;

a central tube extending through the forward, intermediate, and aft compartments;

the intermediate compartment being annular about the central tube and spaced therefrom to form an inner annular space therebetween;

the intermediate compartment being spaced from the outer cylindrical shell to form an outer annular space therebetween;

said inner and outer annular spaces being open to and in communication with the aft fuel compartment;

means for sealing the intermediate compartment to the vehicle so that the forward pressurized fuel compartment and the aft fuel feeding compartment are sealably separated from one another;

an upwardly extending tube mounted in a fore part of the intermediate compartment with a bottom end of the tube opening into a bottom portion of the forward compartment and a top end opening into a top portion of the intermediate compartment; and another upwardly extending tube mounted in an after part of the intermediate compartment with a bottom end spaced from the bottom of the intermediate compartment and a top end in communication with said aft compartment via said outer annular space so that fuel is communicable from the forward compartment to the aft compartment through the intermediate compartment, whereby, upon sloshing of fuel in the forward compartment, gas will be trapped in the intermediate compartment to prevent its travel to the aft compartment.

2. An anti-slosh fuel compartment assembly as claimed in claim 1 including:

an annular hub mounting the intermediate compartment to the central tube so that the intermediate compartment is cantilevered into the aft compartment.

3. An anti-slosh fuel compartment assembly as claimed in claim 2 wherein the sealing means includes:

O-ring means for sealing: (1) the intermediate compartment to the outer shell, (2) the hub to the central tube, and (3) the intermediate compartment to the hub.

4. An anti-slosh fuel compartment assembly as claimed in claim 2 including:

the intermediate compartment having a recess which is located in a bottom portion thereof and which faces aft to receive a fuel feed tube.

5. An anti-slosh fuel compartment assembly as claimed in claim 4 wherein the sealing means includes:

O-ring means for sealing: (1) the intermediate compartment to the outer shell, (2) the hub to the central tube, and (3) the intermediate compartment to the hub.

* * * * *